United States Patent [19]

Sorrentino

[11] 4,122,562

[45] Oct. 31, 1978

[54] SUPPORT FRAME AND POOL COVER

[76] Inventor: Anthony Sorrentino, 45 Pearwood Dr., Huntington Station, N.Y. 11746

[21] Appl. No.: 798,366

[22] Filed: May 19, 1977

[51] Int. Cl.[2] ..... E04H 3/19

[52] U.S. Cl. ..... 4/172.12

[58] Field of Search ..... 4/172.12, 172.13, 172.14; 52/63, 80, 82; 135/3 C, 4 B, DIG. 9, 1 D

[56] References Cited

U.S. PATENT DOCUMENTS

| | | | |
|---|---|---|---|
| 1,204,616 | 11/1916 | Upton | 135/4 B |
| 1,592,356 | 7/1926 | Goldberg et al. | 135/3 C |
| 3,130,488 | 4/1964 | Lindstrom | 4/172.12 X |
| 3,355,745 | 12/1967 | Jannuzzi | 4/172.12 |
| 3,366,977 | 2/1968 | Koehler | 4/172.12 |
| 3,475,768 | 11/1969 | Burton | 4/172.12 |
| 3,683,427 | 8/1972 | Burkholz et al. | 4/172.12 |
| 3,769,639 | 11/1973 | Bishop | 4/172.12 |
| 3,801,994 | 4/1974 | Brown | 4/172.12 |

*Primary Examiner*—Charles E. Phillips

*Attorney, Agent, or Firm*—Posnack, Roberts, Cohen & Spiecens

[57] ABSTRACT

A pool cover including a central frame provided with tubular extension and a ring supported by an inflatable member which floats on the water surface. Tubular supports are connected on the pool perimeter and are connected into the tubular extension. The connections are made by spring-loaded buttons in the tubular supports which fit into slots on the pool perimeter and tubular extensions respectively. A flexible sheet fits on the frame formed by the central frame and tubular supports.

6 Claims, 4 Drawing Figures

Fig. 1.
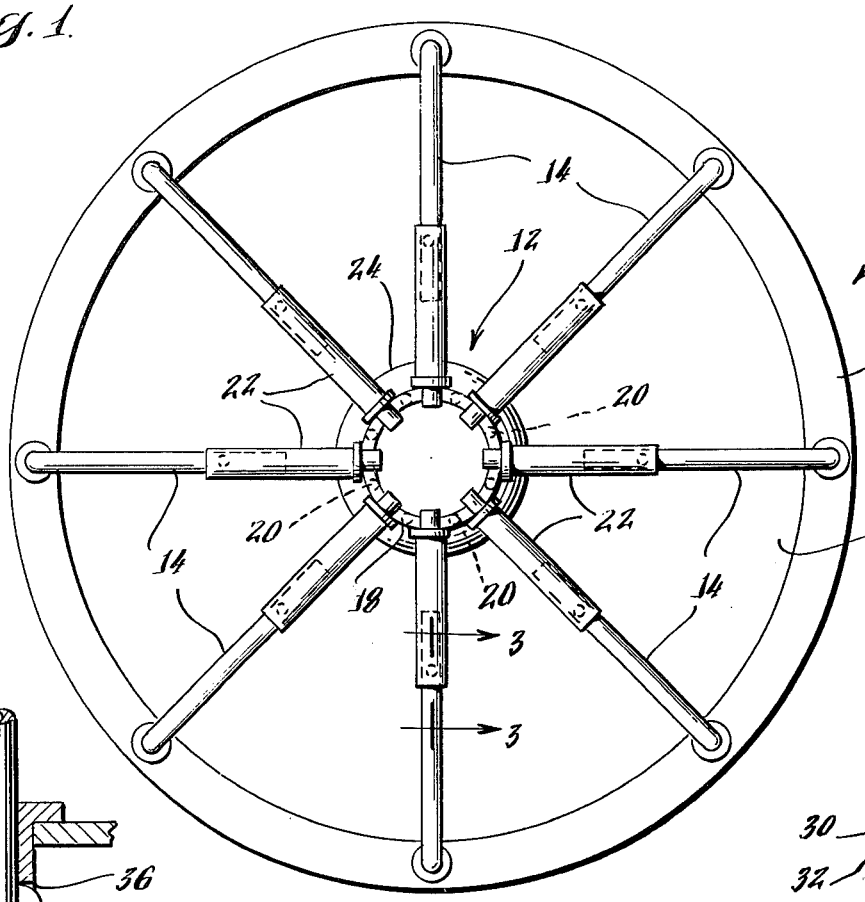
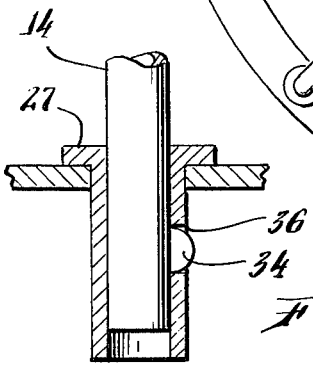
Fig. 4.
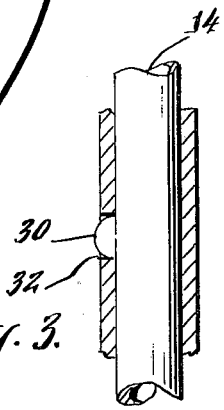
Fig. 3.
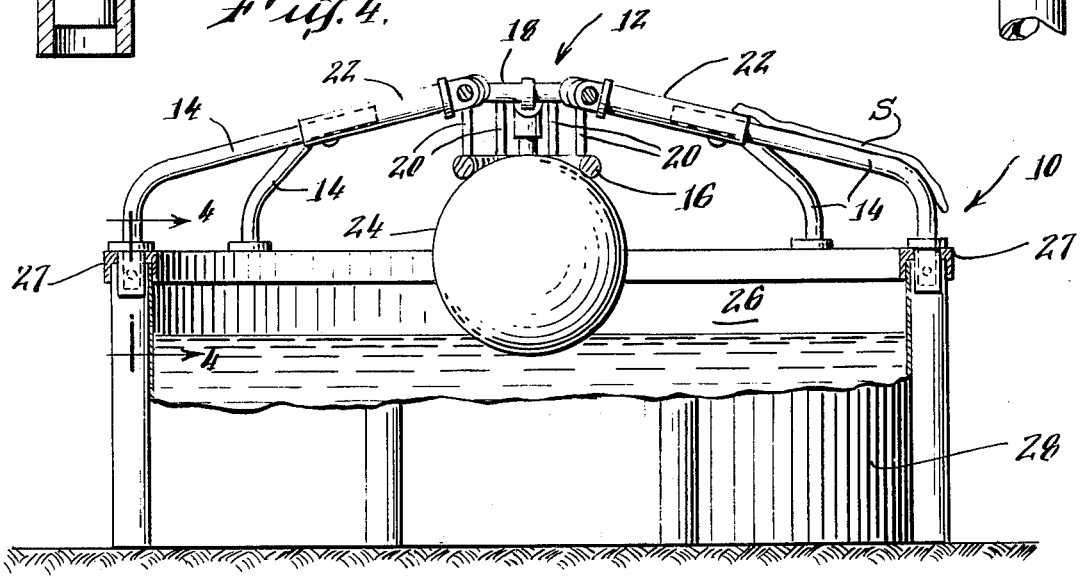
Fig. 2.

SUPPORT FRAME AND POOL COVER

BACKGROUND OF THE INVENTION

1. Field of the Invention

This invention relates to a pool cover construction.

2. Prior Art

Pool covers are used to prevent accumulation of leaves and dirt in the pool water. It is desirable that the pool cover have a domed structure to prevent accumulation of leaves and other materials on the flexible sheet normally used for pool covers so that the flexible sheet does not degrade within a short time.

The F. Jannuzzi U.S. Pat. No. 3,355,745 appears to be of interest in disclosing a protective insulation which includes a cover which is adapted to cover a pool and a floating support for engaging the inner surface of the cover and which is adapted to be moved in different directions by air currents acting on the outer surface of the cover whereby any substantial accumulation on the top of the cover is effectively prevented.

SUMMARY OF THE INVENTION

It is an object of this invention to provide a pool cover having a domed structure.

It is a further object of this invention to provide a pool cover that can be hand assembled without special tools.

Further objects of this invention will become evident in view of the following detailed disclosure.

In accordance with this invention, a pool cover is provided which includes a pool frame and a flexible sheet which fits over the pool frame. The pool frame is formed from a central frame section having tubular extensions pivotally mounted on a ring. The ring is supported by an inflatable member which fits in the ring and floats on the pool water. Tubular supports fit into the tubular extensions and also fit into holes located on the pool perimeter. The tubular supports are provided with spring loaded buttons at each end which fit in slots on the pool perimeter and tubular extensions respectively.

BRIEF DESCRIPTION OF THE DRAWINGS

FIG. 1 is a top view of the pool frame in position.

FIG. 2 is a partial cross-sectional side view of the pool frame of FIG. 1.

FIG. 3 is a cross-sectional view of the tubular extension taken along line 3—3 of FIG. 1.

FIG. 4 is a cross-sectional view of the tubular support taken along line 4—4 of FIG. 2.

DETAILED DESCRIPTION OF THE PREFERRED EMBODIMENTS

Referring to FIGS. 1 and 2, the pool frame 10 includes a central frame member 12 and a plurality of tubular supports 14. The central frame member 12 comprises a bottom or central ring 16 and a top ring 18 joined by vertical supports 20. Tubular extensions 22 are pivotally mounted on top ring 18 to form a tent-like frame therewith. An inflatable balloon 24 or the like floats on the pool water 26 and fits into bottom ring 16 to support central frame 12.

Tubular supports 14 fit within tubular extensions 22 and into holes on the perimeter 27 of pool 28. As shown in FIG. 3, one end of the tubular support 14 fits within the tubular extension 22 and a spring-loaded button 30 fits into hole 32 of tubular extension 22. As shown in FIG. 4, a vertical section of tubular extension 14 fits into a hole in the pool perimeter 27. A spring loaded button 34 fits into a hole 36 on the pool perimeter 27. A conventional flexible sheet S (a fragment of which is shown) fits over and is secured to the pool frame shown such as by being tied to the pool perimeter.

It is to be understood that the present invention is not limited to the embodiments specifically shown but includes modifications which will be evident to the person skilled in the art.

What is claimed is:

1. A pool cover for a pool having a perimeter, said pool cover comprising a pool frame and a sheet means which fits over said pool frame, said pool frame including a central ring, a plurality of tubular extensions pivotally coupled to said ring, a floatation member adapted to fit into said ring and adapted to float on the pool water to support at least part of the weight of said frame and sheet means, and a plurality of tubular supports each adapted to be secured to a respective one of said extensions and to be secured to the perimeter of the pool.

2. The pool cover of claim 1 wherein said tubular supports include spring loaded buttons and are secured to said tubular extensions and to said pool perimeter by said spring loaded buttons which fit into holes provided in said tubular extensions and holes provided in said pool perimeter.

3. The pool cover of claim 1 wherein said frame includes two central rings vertically spaced apart from each other, one of said central rings being adapted to fit over part of said floatation member and the other of said central rings being adapted to pivotally support said tubular extensions.

4. The pool cover of claim 3 wherein said tubular supports include spring-loaded buttons and are secured to said tubular extensions and to said pool perimeter by said spring-loaded buttons which fit into holes provided in said tubular extensions and holes provided in said pool perimeter.

5. A pool cover as claimed in claim 1 wherein the floatation member is a gas-filled member.

6. A pool cover as claimed in claim 1 wherein the sheet means is a flexible sheet.

* * * * *

UNITED STATES PATENT AND TRADEMARK OFFICE

CERTIFICATE OF CORRECTION

PATENT NO. : 4,122,562

DATED : October 31, 1978

INVENTOR(S) : SORRENTINO

It is certified that error appears in the above-identified patent and that said Letters Patent are hereby corrected as shown below:

IN THE CLAIMS:

Claim 1, line 32:

after "said" insert --tubular--

Signed and Sealed this

First Day of May 1979

[SEAL]

Attest:

RUTH C. MASON
*Attesting Officer*

DONALD W. BANNER
*Commissioner of Patents and Trademarks*